US006324856B1

(12) United States Patent
Weng

(10) Patent No.: US 6,324,856 B1
(45) Date of Patent: Dec. 4, 2001

(54) MULTIPLE STAGE CASCADE REFRIGERATION SYSTEM HAVING TEMPERATURE RESPONSIVE FLOW CONTROL AND METHOD

(75) Inventor: Chuan Weng, Weaverville, NC (US)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/611,985

(22) Filed: Jul. 7, 2000

(51) Int. Cl.[7] ..... F25B 7/00
(52) U.S. Cl. ..... 62/175; 62/335
(58) Field of Search ..... 62/175, 335

(56) References Cited

U.S. PATENT DOCUMENTS

| | | | | |
|---|---|---|---|---|
| 2,680,956 | * | 6/1954 | Haas | 62/335 |
| 3,392,541 | * | 7/1968 | Nussbaum | 62/335 |
| 3,733,845 | * | 5/1973 | Lieberman | 62/335 |
| 3,852,974 | * | 12/1974 | Brown | 62/175 |
| 4,019,337 | | 4/1977 | Zearfoss, Jr. | 62/113 |
| 4,028,079 | | 6/1977 | Scheibel | 62/335 |
| 4,325,226 | * | 4/1982 | Schaeffer | 62/335 |
| 4,932,220 | * | 6/1990 | Inoue | 62/175 |
| 5,157,943 | | 10/1992 | Jaster et al. | 62/513 |
| 5,170,639 | | 12/1992 | Datta | 62/228.3 |
| 5,910,166 | | 6/1999 | Mitchell et al. | 62/511 |

OTHER PUBLICATIONS

CSW Corporation CPL PSO SWEPCO WTU Refrigeration—Basic Cycle Concepts (2 pages).

CSW Corporation CPL PSO SWEPCO WTU Refrigeration System Operating Characteristics (2 pages).

ASHRAE Journal—Refrigeration Control Devices (5 pages).

* cited by examiner

*Primary Examiner*—William E. Tapolcai
(74) *Attorney, Agent, or Firm*—Pepper Hamilton, LLP

(57) ABSTRACT

A refrigeration system having a flow control mechanism to selectively increase or decrease refrigerant flow in response to system temperature. In the preferred embodiment, a cascade refrigeration system having a high temperature first stage with a compressor, condenser, flow control device and heat exchanger. The low temperature second stage has a compressor, flow control device, evaporator and heat exchanger. The first stage is in a heat exchange relationship with the second stage through the common heat exchanger, which functions as condenser in the second stage. A controller responsive to temperature sensed at the second stage evaporator outlet operates a valve to increase or decrease refrigerant flow in the first stage. Increased refrigerant flow improves refrigeration system response to large heat loads, while maintaining efficient operation under normal conditions.

8 Claims, 1 Drawing Sheet

FIRST STAGE CONDENSER
HEAT EXCHANGER
54
52
24
CONTROLLER
50

FIRST STAGE CONDENSER
HEAT EXCHANGER
56
58
24
CONTROLLER
50

12
14
30
32
16
FIRST STAGE
18
HEAT EXCHANGER
46
48
SECOND STAGE
36
40
44
38
20
FLOW CONTROL DEVICE
22
FLOW CONTROL DEVICE
34
FLOW CONTROL DEVICE
10
24
CONTROLLER
50

MULTIPLE STAGE CASCADE REFRIGERATION SYSTEM HAVING TEMPERATURE RESPONSIVE FLOW CONTROL AND METHOD

TECHNICAL FIELD

This invention relates to the field of refrigeration systems, and more particularly, to cascade compression refrigeration systems.

BACKGROUND

Refrigeration systems are sometimes used to provide ultra-cold conditions for various applications. Refrigeration system parameters are generally designed for efficient operation under normal operating conditions, where the refrigeration system removes only ambient heat gain from the temperature controlled space to maintain temperature. Such systems do not adequately meet the greater cooling demands encountered on initial cool down of the controlled space, or during periods of increased access. In a typical compressive, two-stage cascade ultra-low temperature refrigeration system cooling capacity is determined primarily by the flow rate of the refrigerant through the expansion or flow control devices when the system compressors are operating.

SUMMARY OF THE INVENTION

The present invention provides for increased refrigerant flow in response to system temperatures warmer than an operator selected temperature. In the preferred embodiment, refrigerant flow is controlled in the higher temperature first stage of a compressive, cascade ultra-low temperature refrigeration system in response to higher-than-desired second stage evaporator outlet temperature. A temperature sensor at the evaporator output sends a signal to a controller. The controller operates a valve to increase refrigerant flow in the first stage, increasing system capacity. The valve allows some refrigerant to bypass the normal or primary flow control device, flowing through a second flow control device. The increased flow in the first stage results in increased pressure in the first stage side of the heat exchanger. The heat exchanger transfers heat from the second stage side to the first stage side in a cascade refrigeration system. The increased first stage pressure results in increased refrigerant flow in the second stage. The increased flow provides more efficient system operation when large cooling demands are present. When evaporator outlet temperature returns to the desired range, the controller operates the valve to restore the normal refrigerant flowpath, reducing refrigerant flow in the first stage to the normal condition.

DETAILED DESCRIPTION

Figures 1, 2, 3:
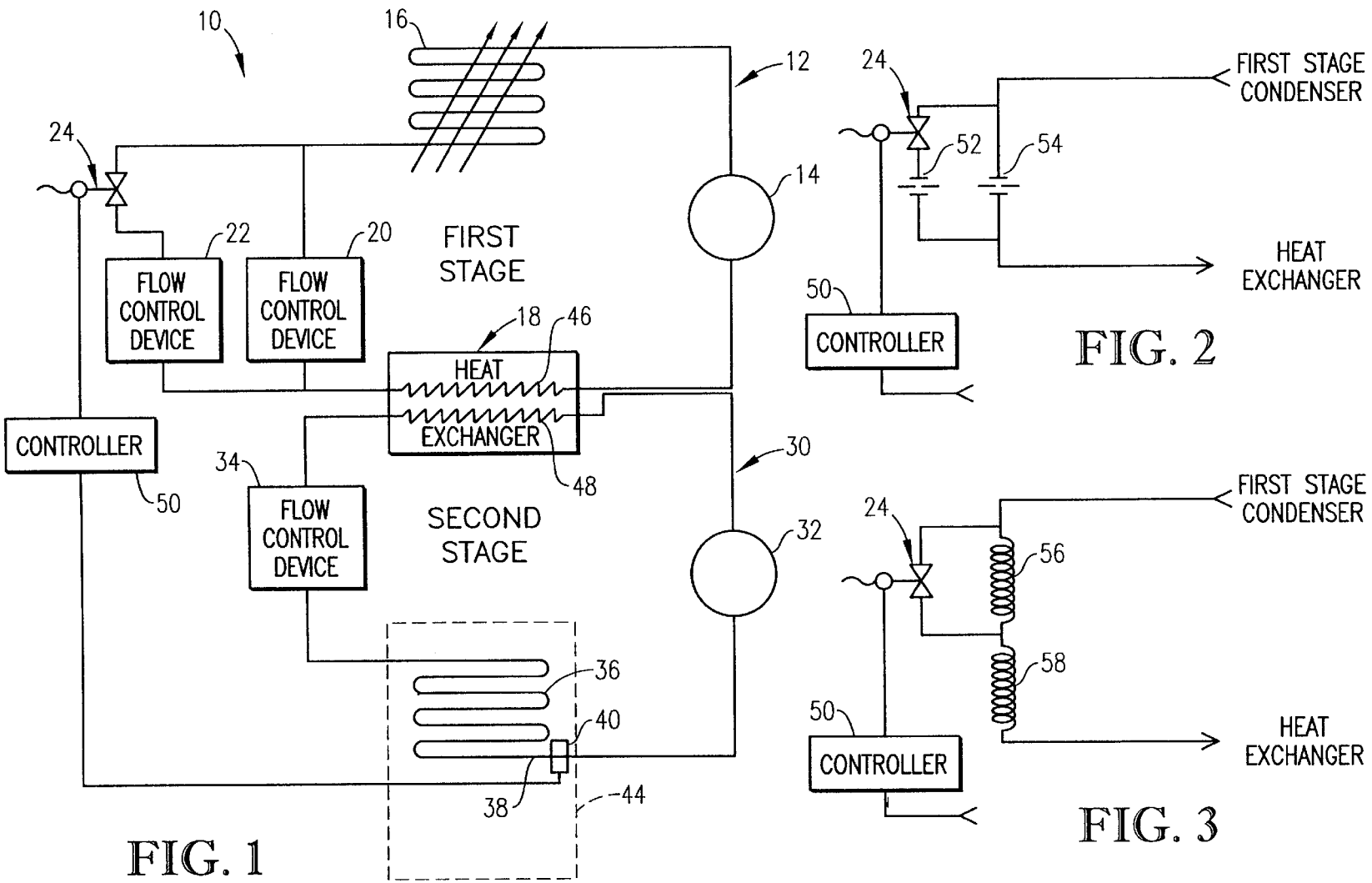
FIG. 1 is a schematic representation of a preferred embodiment of the present invention in a two stage cascade compressive refrigeration system.
FIG. 2 is a partial schematic representation of a second embodiment where the first stage flow control devices are orifices.
FIG. 3 is a partial schematic representation of a third embodiment where the first stage flow control devices are capillary tubes.

FIG. 1 illustrates schematically the present invention in a basic two stage compressive cascade refrigeration system

10. System 10 includes a circuit comprising a high temperature or first stage 12 and a low temperature or second stage 30. First stage 12 includes a first stage compressor 14, a condenser 16, a heat exchanger 18, a primary flow control device 20, a secondary flow control device 22, and a solenoid valve 24. A suitable first stage refrigerant, such as R-134A (using the American Society of Heating, Refrigerating and Air Conditioning Engineers standard nomenclature), flows through the first stage 12. Second stage 30 includes a second stage compressor 32, a second stage flow control device 34, an evaporator 36 with an outlet 38, and a temperature sensor 40. A suitable second stage refrigerant, such as R508B, circulates in the second stage to cool a temperature controlled space 44. First stage 12 and second stage 30 are in a heat exchange relationship via heat exchanger 18. Heat exchanger 18 contains a first stage side 46 and a second stage side 48. A controller 50 operates solenoid valve 24 based on inputs from the operator and temperature sensor 40. Practitioners of the art will understand that many types of heat exchangers are commercially available, and that most refrigeration systems have additional components that improve efficiency, but are not necessary for the basic refrigeration cycle.

In a compressive refrigeration cycle during normal operation, as shown in FIG. 1, first stage compressor 14 draws in low pressure vapor first stage refrigerant and discharges high pressure vapor first stage refrigerant to condenser 16. In condenser 16 high pressure vapor first stage refrigerant is condensed by heat transfer, releasing the latent heat of condensation to the surrounding environment. Typically this heat transfer is enhanced by forcing air over condenser 16. High pressure liquid first stage refrigerant flows out of condenser 16 to primary flow control device 20. Primary flow control device 20 restricts flow and reduces the pressure of first stage refrigerant. Solenoid valve 24 is normally shut, preventing flow through secondary flow control device 22. Low pressure liquid first stage refrigerant changes state to low pressure vapor first stage refrigerant in first stage side 44 of heat exchanger 18, absorbing the latent heat of vaporization from second stage refrigerant. Low pressure vapor first stage refrigerant is drawn back into first stage compressor 14, repeating the stage.

Heat exchanger 18 condenses high pressure vapor second stage refrigerant in second stage side 48. Second stage refrigerant is in a high pressure liquid state flowing out of second stage side 48 and into second stage flow control device 34. Second stage flow control device 34 restricts flow and reduces the pressure of liquid second stage refrigerant. Low pressure liquid second stage refrigerant circulates from second stage flow control device 34 into evaporator 36, absorbing heat from temperature controlled space 44 across evaporator 36. Low pressure vapor second stage refrigerant circulates from evaporator outlet 38 to second stage compressor 32. Second stage compressor 32 compresses second stage refrigerant to a high pressure vapor form, sending it into second stage side 48 of heat exchanger 18 where it cools and condenses to high pressure liquid second stage refrigerant, completing the transfer of heat from temperature controlled space 44.

Broadly speaking, controller 50, solenoid valve 24 and secondary flow control valve 22 comprise a flow control mechanism operable to selectively increase or decrease refrigerant flow in first stage 12 in response to the temperature sensed by sensor 40. During initial system start-up the temperature of space 44 is warmer than the desired temperature and the heat load on system 10 is large. Temperature sensor 40 at outlet 38 provides evaporator outlet temperature to controller 50. An evaporator outlet temperature warmer than that set by the operator at controller 50 results in a signal from controller 50 to open solenoid valve 24. Opening valve 24 places secondary flow control device 22 in a parallel flow relationship with primary flow control device 20, increasing first stage refrigerant flow, raising first stage refrigerant pressure in first stage side 46. Second stage refrigerant is in a heat exchange relationship with first stage refrigerant in heat exchanger 18. Therefore, second stage refrigerant condensing pressure rises, increasing second stage refrigerant flow in second stage 30. The increased flow in first stage 12 and second stage 30 results in more rapid removal of heat from temperature controlled space 44.

Temperature sensor 40 continues to provide inputs to controller 50. When temperature at evaporator outlet 38 becomes cooler than the temperature set by the operator, controller 50 operates solenoid valve 24 to stop flow through secondary flow control device 22, reducing first stage refrigerant flow in first stage 12. Because second stage 24 is in a heat exchange relationship with first stage 12 through heat exchanger 18, reduced flow in first stage side 46 results in a lower condensing pressure in second stage side 48 and reduced second stage refrigerant flow. The reduced flow allows system 10 to reach the lowest designed temperatures.

The present invention allows the refrigeration system to reach desired operating conditions more quickly on initial system start-up, during periods of frequent access or when an abnormally large heat load is placed on the system.

Different types of flow control devices may be employed as flow control devices 20, 22. One example of a suitable flow control device is capillary tubing. National Copper Products of Dowagiac, Mich. can supply capillary tubing, sized for use as a refrigeration flow control device, such as 0.054"×200" or 0.065"×45'. An acceptable solenoid valve can be obtained from Alco Control Division of Hazlehurst, Ga. ALCO part number 100RB2S3. A Signetics/Phillips 80C552 Micro-controller, suitable to control solenoid valve 24, can be purchased through TECEL Microcomputers, Albuquerque N. Mex. In operation, a Model S15919PD 100 ohm RTD temperature sensor manufactured by Heraeus Sensor-Nite International, sales office in Newtown, Pa., provided adequate temperature sensing.

FIG. 2 shows a second embodiment in which the primary flow control device 20 and the secondary flow control device 22 take the form of a pair of restricted orifices 52, 54.

FIG. 3 illustrates a third embodiment wherein the first stage flow control device includes of a pair of capillary tubes 56, 58 connected in series flow relationship. When temperature sensed at outlet 38 is too warm, controller 50 opens solenoid valve 24, allowing first stage refrigerant flow through the path of least resistance, bypassing capillary tube 56, increasing first stage refrigerant flow.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the invention as pertains to any apparatus not materially departing from but outside the literal scope of the invention as set out in the following claims.

What is claimed is:

1. In a refrigeration system in which refrigerant flows in a circuit, the improvement comprising:

a temperature sensor operable to sense the temperature at a certain location of said circuit; and flow control mechanism operable to selectively increase or decrease refrigerant flow in said circuit in response to the temperature sensed by said sensor at said certain location, said circuit including a plurality of separate, closed refrigeration loops in heat exchange relationship with one another wherein the minimum temperature of the refrigerant is progressively lower in each successive loop, said temperature sensor being disposed to sense refrigerant temperature in one of said loops and the flow control mechanism being operable to vary the flow rate of refrigerant in another of said loops.

2. In a refrigeration system as in claim 1, said circuit includes an evaporator having an upstream said and a downstream side with respect to the direction of refrigerant flow, said certain location comprising the downstream side of said evaporator.

3. In a refrigeration apparatus as in claim 1, one of said loops includes an evaporator having an upstream side and a downstream side with respect to the direction of refrigerant flow, said certain location comprising the downstream side of said evaporator.

4. In a refrigeration system as claimed in claim 3, said flow control mechanism including a plurality of flow control devices within said other loop, valving operable to permit simultaneous flow through a variable number of said devices in a manner to increase the rate of flow in said other loop as the number of said devices increases, and a controller operably connected to said valving and responsive to said temperature sensor.

5. In a refrigeration system as claimed in claim 4, said controller being operable to increase the number of flow control devices through which refrigerant flows as the temperature sensed by said sensor becomes warmer than a certain predetermined level.

6. In a refrigeration system as claimed in claim 5, said flow control devices being connectable in parallel flow relationship by said valving.

7. In a refrigeration system as claimed in claim 5, said flow control devices comprising capillary tubes.

8. In a refrigeration system as claimed in claim 5, said flow control devices comprising restricted orifices.

* * * * *